US006915724B2

(12) United States Patent
Kigel et al.

(10) Patent No.: US 6,915,724 B2
(45) Date of Patent: Jul. 12, 2005

(54) APPARATUS FOR DRIVING FASTENERS, INCLUDING SCREWS, NAILS, POP RIVERTS AND STAPLES

(75) Inventors: Alexander Kigel, Bremen (DE); Volker Reiss, Bremen (DE)

(73) Assignee: Helfer & Co. KG (DE)

( * ) Notice: Subject to any disclaimer, the term of this patent is extended or adjusted under 35 U.S.C. 154(b) by 0 days.

(21) Appl. No.: 10/664,812

(22) Filed: Sep. 17, 2003

(65) Prior Publication Data

US 2004/0123704 A1 Jul. 1, 2004

(30) Foreign Application Priority Data

Sep. 19, 2002 (DE) ..... 202 14 489 U

(51) Int. Cl.[7] ..... B25B 23/04
(52) U.S. Cl. ..... 81/434; 81/433; 81/435; 173/93.5
(58) Field of Search ..... 81/434, 433, 435, 81/57.44, 57.31; 173/93.5

(56) References Cited

U.S. PATENT DOCUMENTS 5,931,366 A * 8/1999 Muro ..... 227/137
6,186,035 B1 * 2/2001 Jalbert et al. ..... 81/434
6,230,594 B1 * 5/2001 Jalbert et al. ..... 81/434
6,244,140 B1 * 6/2001 Habermehl ..... 81/434
6,363,818 B1 * 4/2002 Habermehl ..... 81/434
6,425,306 B1 * 7/2002 Habermehl ..... 81/434
6,769,332 B2 * 8/2004 Muro ..... 81/434

FOREIGN PATENT DOCUMENTS

| | | |
|---|---|---|
| DE | 42 08 715 | 3/1992 |
| DE | 197 31 949 | 7/1997 |
| DE | 298 22 080 | 12/1998 |
| GB | 1208212 | 3/1968 |
| WO | PCT/US98/18904 | 9/1998 |

* cited by examiner

*Primary Examiner*—Joseph J. Hail, III
*Assistant Examiner*—Alvin J. Grant
(74) *Attorney, Agent, or Firm*—Altera Law Group, LLC

(57) ABSTRACT

Apparatus for driving fasteners, in particular screws, nails, pop rivets, and staples, is disclosed. It has a motor-drivable feeder that moves the fasteners sequentially from a feed position into a driving position, and with an adjustor has a manually rotatable threader mounted stationary on the feeder. The thread engages interlockingly with the stop member.

13 Claims, 8 Drawing Sheets

A–A

APPARATUS FOR DRIVING FASTENERS, INCLUDING SCREWS, NAILS, POP RIVERTS AND STAPLES

BACKGROUND OF THE INVENTION

The invention relates to equipment for driving fasteners, in particular screws, nails, pop rivets, staples or the like, with a motor-drivable feeder.

Such equipment is known and is used in various configurations for driving fasteners into workpieces, and in particular for driving a plurality of fasteners in rapid succession. With such equipment, it is not necessary to remove the fasteners manually from a bulk pack, attach them to the workpiece and apply the matching tool to the fastener; instead, the fasteners are automatically fed by the drivable feeder to the location where they are to be driven into the workpiece, and the fasteners are guided in such a manner that the driving tool automatically engages with the fastener that has been fed to it.

It is preferred in industry and the craft trades to use tools with feeders of the aforementioned kind when it is necessary to drive a plurality of fasteners into a workpiece in rapid succession and at speed.

BRIEF SUMMARY

The aforementioned tools usually have a stop member that is placed against the workpiece prior to the screwdriving process so that the fasteners can be driven into the workpiece with precision as regards their position and alignment. To achieve such precision, it is advantageous if the end of the fastener pointing in the screwdriving direction to the workpiece is slightly spaced apart from the stop member. Usually, fasteners of different lengths can be driven using equipment of the aforesaid kind. In order to achieve the desired small spacing to the workpiece when fasteners of different lengths are driven, it is therefore necessary to provide a means for adjusting the position of the stop member relative to the screw feeder.

A known way of enabling such adjustment is to attach the stop member to the feeder by means of screws, usually several screws, and to provide a plurality of spaced apart holes in the stop member through which the attachment screws can be inserted. The stop member can then be adjusted by loosening the screws fastened in threaded holes in the feeder, sliding the stop member until a different hole is aligned with the threaded holes in the feeder and then driving the screws back into the threaded holes. DE 42 08 715 provides an example of such a configuration.

One disadvantage of the latter configuration is that a tool is needed for adjusting the stop base, namely for loosening and then retightening the screws. Said tool may be lost and is not always at hand when an adjustment has to be made. This diminishes the ease of operation of the screwdriving tool.

This problem is solved by known tool-less adjusters which provide locking means that are pressed by elastic pretensioning into a locking position in which they lock the stop base of the stop member in place relative to the feeder housing by positive engagement. By pressing the locking means against the elastic pretensioning force, the positive engagement is cancelled, thus enabling the stop base of the stop member to be moved to a different position relative to the feeder housing. The snap-locking means is so designed that several defined positions are possible. One such configuration can be found in DE 197 31 949, for example.

Said locking means is prone to interference and, particularly when the driving tool is used in dusty environments, as is generally the case when used on building sites, particles can stop the locking means working properly, with the result that it is not possible for the stop member to lock reliably onto the feeder housing.

A common disadvantage of the aforementioned configurations is also that continuous adjustment of the stop member relative to the housing is not possible. This substantially limits the extent to which they can be adjusted.

The object of the invention, therefore, is to provide a means of reliable, continuous adjustment that enables tool-less adjustment of the stop member relative to the feeder.

Said object is achieved in equipment of the kind initially specified in that the adjustment means comprises a manually rotatable thread member mounted stationary in or on the feeder, the thread of said thread member engaging interlockingly with the stop member and moving the stop member continuously relative to the feeder when turned.

The invention makes possible the simple, quick, tool-less and continuous adjustment of the stop member relative to the feeder by means of a thread member and without an adjustment tool being required. The thread member may be configured in such a way that its angle of rotation is proportional to the shift in position of the stop member relative to the feeder. This enables simple, tool-less and continuous adjustment to be carried out.

Preferably, the thread member is mounted stationary but rotatable in or on the feeder and engages with the stop member. Simple reversal of this adjustment principle results in an embodiment in which the thread member is mounted stationary in or on the stop member and engages with the feeder. This embodiment likewise enables advantageous adjusting pursuant to the invention and may be advantageous in some feeder or equipment constructions.

The thread member must preferably be arranged in such a way that it projects at least partially from the feeder/stop member and can thus be manually operated.

Alternatively, the thread member may be connected torque-resistantly to adjustment means so that the thread member can be turned by operating said adjustment means, which may be a crank, a handwheel.

In a preferred embodiment of the equipment according to the invention, the thread of the thread member is an external thread with its axis running parallel to the screwdriving direction. This design of the thread member enables very simple assembly of the equipment as well as very ergonomic adjustment of the stop member.

The equipment according to the invention may be developed by providing the thread member with a manually operable portion. The manually operable portion may be located in the area of the thread itself, or at a portion of the thread member adjacent to the thread. It is particularly advantageous to roughen, knurl or likewise treat the thread member at the manually operable surface of the thread in order to facilitate manual operation. It is also advantageous to provide the thread portion of the thread member with a trapezoidal thread that is sufficiently robust. Such a trapezoidal thread can also be manually well operated, thus enabling a design in which a thread portion projecting from the feeder/stop member to be manually and directly accessed for adjustment. As in one embodiment, the surfaces of the thread, in particular the cylindrical surfaces with nominal diameters, may be roughened, knurled or the like in order to make manual operation easier.

The equipment with a thread member according to the invention can be advantageously developed by having the thread of the thread member extend radially through the stop member.

In such an embodiment, it is preferable that the thread member extends only with the nominal diameter through the stop member, whereas the core diameter does not extend through it, or only partially. In this way, the thread flanks can engage positively where they extend through the stop member, and can transfer a force from the thread member onto the stop member.

The aforementioned embodiment can be further developed by providing the stop member with at least one ridge disposed perpendicular to the screwdriving direction in order to establish positive mating with the thread of the thread member, said ridge(s) having a width that limits the axial path of the thread on both sides.

The thread flanks act against the outer surfaces of the ridge that run perpendicular to the screwdriving direction, such that positive engagement between the thread flanks and said ridge surfaces is achieved. By means of said positive engagement, a force can be transferred from the thread member mounted stationary in the housing onto the stop member when the thread member is moved. This positive engagement also serves to transfer forces from the stop member onto the housing when the stop member is placed on the workpiece in the driving process, such that the stop member can support itself on the housing.

An advantageous embodiment of the equipment according to the invention is characterized in that the thread member is a rotationally symmetric member with a central bore through which a force transmission member of the motor drive can pass during the screwdriving process.

Possible force transmission members include, for example, sockets with four, six or twelve sides on the inside or outside, or bits for standard, commonly available screws, such as cross-recessed, flat slotted or torx screws.

Another advantageous embodiment of the equipment according to the invention is characterized in that the stop member is configured as a U-shape and has slots on its two side shanks, which extend parallel to the screwdriving direction and are guided on two opposite sides of the feeder, and that the stop face is located on the side of the ridge facing away from the feeder and has a hole through which the fasteners can pass.

The stop member is guided in such a way that movement in the screwdriving direction is possible, whereas movements transverse to the screwdriving direction are prevented by the guide means. Preferably, the stop face is approximately perpendicular to the screwdriving direction.

The opening in the stop face may be configured as a cylindrical recess, for example. Said opening must be dimensioned in such a way that the entire fastener can pass through it, i.e. including the screw head when screws are used as fasteners.

In another embodiment of the invention, the thread member has an internal thread and the stop member has an external thread or portions of an external thread. In this embodiment, the housing or parts of the housing are located inside the thread member and an outer circumferential surface of the thread member partially encloses the housing. Said outer circumferential surface is particularly good for manual operation, thus enabling simpler adjustment.

In another advantageous embodiment of the invention, the stop member has at least one protrusion that at least engages with the thread of the thread member so that force can be transmitted interlockingly between the thread flanks and at least one surface of the protrusion. In particular, a plurality of protrusions arranged in series like a toothed rack may be provided.

The equipment according to the invention may also be developed such that the thread member is a rotationally symmetric member with its axis of rotation lying parallel to the screwdriving direction and spaced apart from the screwdriving axis.

In the latter embodiment, the thread member may be positioned to the side of, and/or above or below the feeder and extend partially into the feeder. This latter arrangement of the thread member enables very simple design and assembly, in that the thread member is spaced apart from the area immediately surrounding the driving axis in which the fasteners, the guides for the fasteners and coupling elements must be arranged in order to direct the driving force into the fasteners.

Finally, one other embodiment of the invention is characterized in that the stop member is U- or L-shaped and is guided along the feeder with at least one side shank extending parallel to the screwdriving direction, and that a protrusion is formed on an edge of at least one side of the stop member extending parallel to the screwdriving direction. In this embodiment, a portion of the edge may be configured as a toothed rack portion with which the thread member engages.

Another preferred embodiment of the equipment according to the invention is characterized in that the equipment is coupled with a mains- or battery-powered motor for driving the feeder.

Possible tools include, in particular, hand tools driven by compressed air or electricity. These tools drive the fasteners into the workpiece by means of a regular turning movement about the driving axis and/or by impacts delivered in the screwdriving direction. The equipment according to the invention is connected to the latter tools and, after the first fastener has been driven in, feeds another fastener in such a way that the second fastener is moved to a position in the screwdriving axis where it can be engaged by the coupling means for delivering the screwdriving force/torque.

In particular, the tool may have a cylindrical surface whose central axis is parallel to the screwdriving direction and to which the equipment according to the invention is attached by force-locking or positive engagement.

This enables the equipment of the invention to be mounted easily and centeredly onto the tool. This method of attachment is also advantageous because the drive motors made by a given manufacturer often have cylindrical surfaces with the same dimensions, thus enabling a form of attachment that can be used universally for different models.

BRIEF DESCRIPTION OF THE DRAWINGS

Preferred embodiments of the invention shall now be explained with reference to the enclosed drawings. The drawings show.

DETAILED DESCRIPTION

Figure 1:
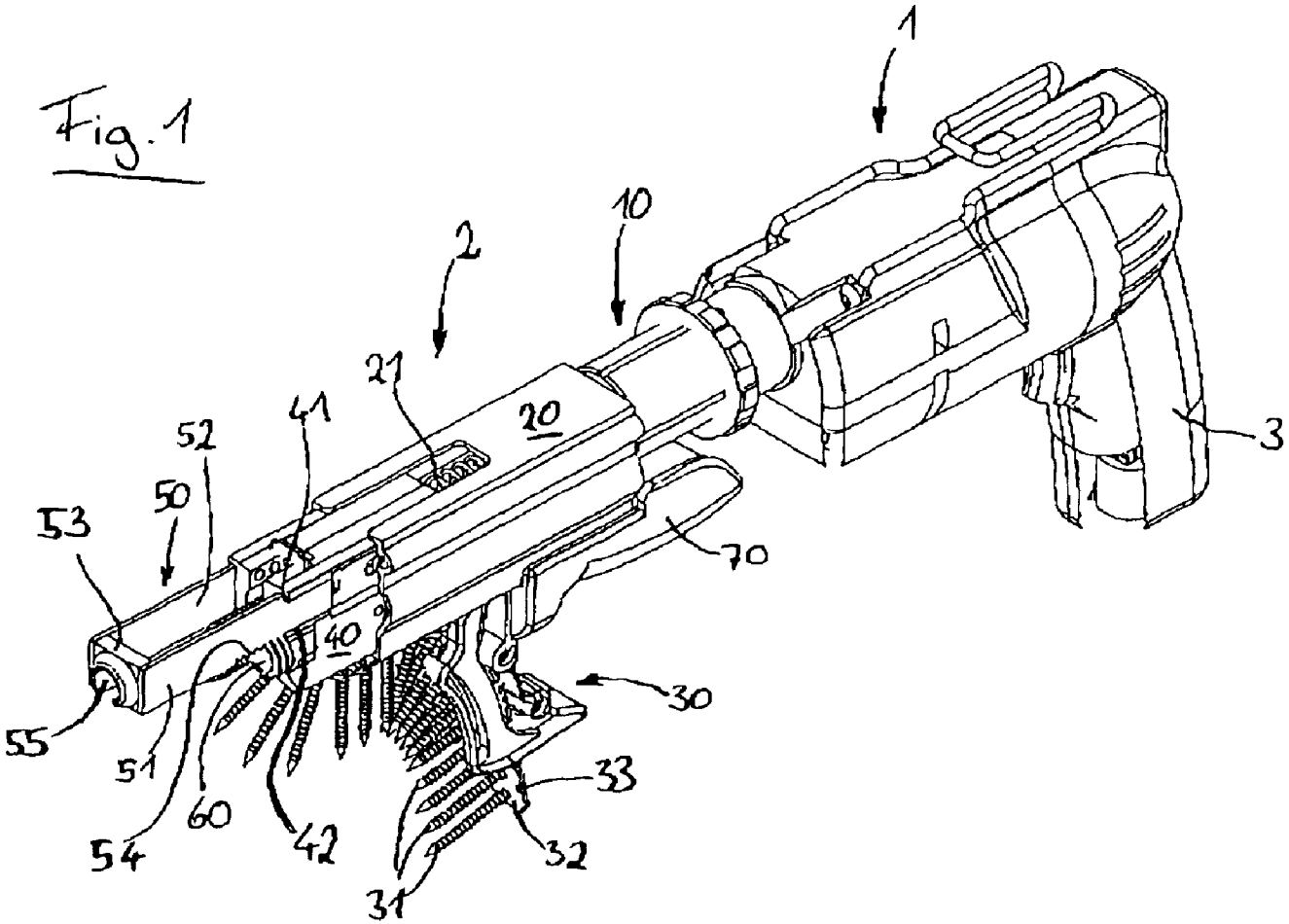
FIG. 1 a perspective view of a first embodiment of the equipment according to the invention, as seen at an angle from above, FIG. 2 a perspective view of the equipment in FIG. 1, as seen at an angle from below, FIG. 3 a plan view of the equipment in FIG. 1, FIG. 4 a side elevation view of the equipment in FIG. 1, FIG. 5 a front view of the equipment in FIG. 1, FIG. 6 a perspective view of the adjustment means for the equipment in FIG. 1, seen at an angle from above, FIG. 7 a perspective view of the adjustment means in FIG. 6, as seen at an angle from below, FIG. 8 a side elevation view of the adjustment means in FIG. 6, FIG. 9 a partly cutaway side elevation view of the adjustment means in FIG. 6, FIG. 10 a front view of the adjustment means in FIG. 6, FIG. 11 a perspective view of a second embodiment of an adjustment means according to the invention, seen at an angle from above, FIG. 12 a perspective, partly cutaway view of the adjustment means shown in FIG. 11, FIG. 13 another perspective, partly cutaway view of the adjustment means shown in FIG. 11, FIG. 14 a plan view of the adjustment means shown in FIG. 11, FIG. 15 partly cutaway plan view of the adjustment means shown in FIG. 11, FIG. 16 a side elevation view of the adjustment means shown in FIG. 11 and FIG. 17 a front view of the adjustment means shown in FIG. 11.

In the following description of the figures, directional and locational details relate to a fastening tool 1, 2 held in a normal working position, and to equipment according to the invention, attached to said tool, for driving fasteners, said equipment having an adjustment means 2. In this normal working position, the driven axis of a drive motor 1 is horizontal and the longitudinal axis of handle 3 of the drive machine is approximately vertical, the free end of handle 3 pointing in the direction of gravitational pull, in other words to the floor. In this working position, "below"=to the floor, "above"=away from the floor, "front"=in the direction of screwdriving movement, "back"=contrary to the direction of screwdriving movement, "side"=transverse to the screwdriving direction and transverse to the normal axis extending from below to above. Of course, the entire equipment can also be used in other positions.

As can be seen from FIGS. 1–10, a first embodiment of an equipment according to the invention comprises an electrically powered drive motor 1 and a feeder 2 flange-mounted to said drive motor. The feeder 2 is connected to drive motor 1 by means of a flange-clamped connector 10 positioned concentric to the rotational axis of the drive shaft of the drive motor. The flange-clamped connector 10 fixes a first housing portion 20 of the feeder device 2 to the housing of drive motor 1 in a stationary position.

On the lower side of feeder device 2 there is disposed a magazine 30 into which a plurality of screws 31 connected at their screw heads by a magazine belt 32 can be fed. Screws 31 may also be referred to as fasteners. Inside the first housing portion 20, a second housing portion 40 is disposed that is displaceable relative to the first housing portion 20. The second housing portion 40 can move relative to the first housing portion 20 in the direction of the rotational axis of drive motor 1. A pressure spring 21 that operates between the first and the second housing portion 20, 40 presses the second housing portion 40 into a first starting position in which the second housing portion 40 is maximally spaced apart from drive motor 1.

A stop member 50 is fixedly attached to the end of the second housing portion 40 facing away from drive motor 1. The stop member 50 is U-shaped and comprises a left-hand and a right-hand shank 51, 52 as well as a stop base 53 connecting the two shanks 51, 52 at the one end of the stop member 50 located opposite the point where the stop member 50 is attached to the second housing portion 40.

A gearwheel portion 54 is defined at the lower edge of the left-hand shank 51. Said gearwheel portion 54 cooperates with a threaded worm 60 that is rotatably mounted at a fixed position underneath the stop member 50 to the second housing portion 40; threaded worm 60 is a thread member according to the invention. The rotational axis of the threaded worm 60 lies parallel to the rotational axis of the driven shaft of drive motor 1. Due to the cooperation between the threaded worm 60 and the gear rack portion 54, a turn on the threaded worm 60 causes a displacement of the stop member 50 relative to the second housing portion 40 in a direction parallel to the rotational axis of the threaded worm 60.

The stop member 50 is guided on the second housing portion 40 in such a way that it can only perform a movement in the axial direction, i.e. in the direction of the longitudinal axis of the stop member shanks 51, 52, or the rotational axis of threaded worm 60. The guide for stop member 50 is formed by a groove 41 defined on the second housing portion 40, said groove engaging on three sides the upper edge 55 of the left-hand stop member shank 51 opposite gearwheel portion 54. In addition, the lower edge of the left-hand stop member shank 51 is guided in a second groove 42 opposite guide groove 41. The right-hand stop member shank 52 is guided at its lower and upper edge and at its surface facing the left-hand stop member shank by guide surfaces 43, 44 defined on the second housing portion 40.

In the magazine portion 30, the magazine belt 32 with the screws 31 inserted therein can be guided from below. Magazine portion 30 has two curved guide grooves that accept the side edges of the magazine belt 32 so as to guide the magazine belt 32 by this means. The magazine portion 30 has a lengthwise opening to the front, through which the screws fastened in magazine belt 32 can extend when the magazine belt 32 is inserted in magazine portion 30. In magazine portion 30, magazine belt 32 is deflected by about 90° forwards in its direction of feed movement from one running upwards from below, to a direction of feed movement extending in the direction of movement of the second housing portion 40 relative to the first housing portion 20. In one portion under the front end of the second housing portion 40, the magazine belt 32 is deflected upwards by about 90° and subsequently runs in about the same direction in which it is also fed into magazine portion 30.

After the second deflection, the magazine belt 32 runs approximately perpendicular to the rotational axis of a screwdriver bit (not shown), said bit being located inside the second housing portion 40 and having its rotational axis parallel to the rotational axis of the driven shaft of drive motor 1. Owing to this orientation of the magazine belt, the screwdriver bit is able to engage with the head of screw 31, which is fastened approximately perpendicular on and to the portion of the magazine belt 32 located inside the stop member 50.

Figure 2:
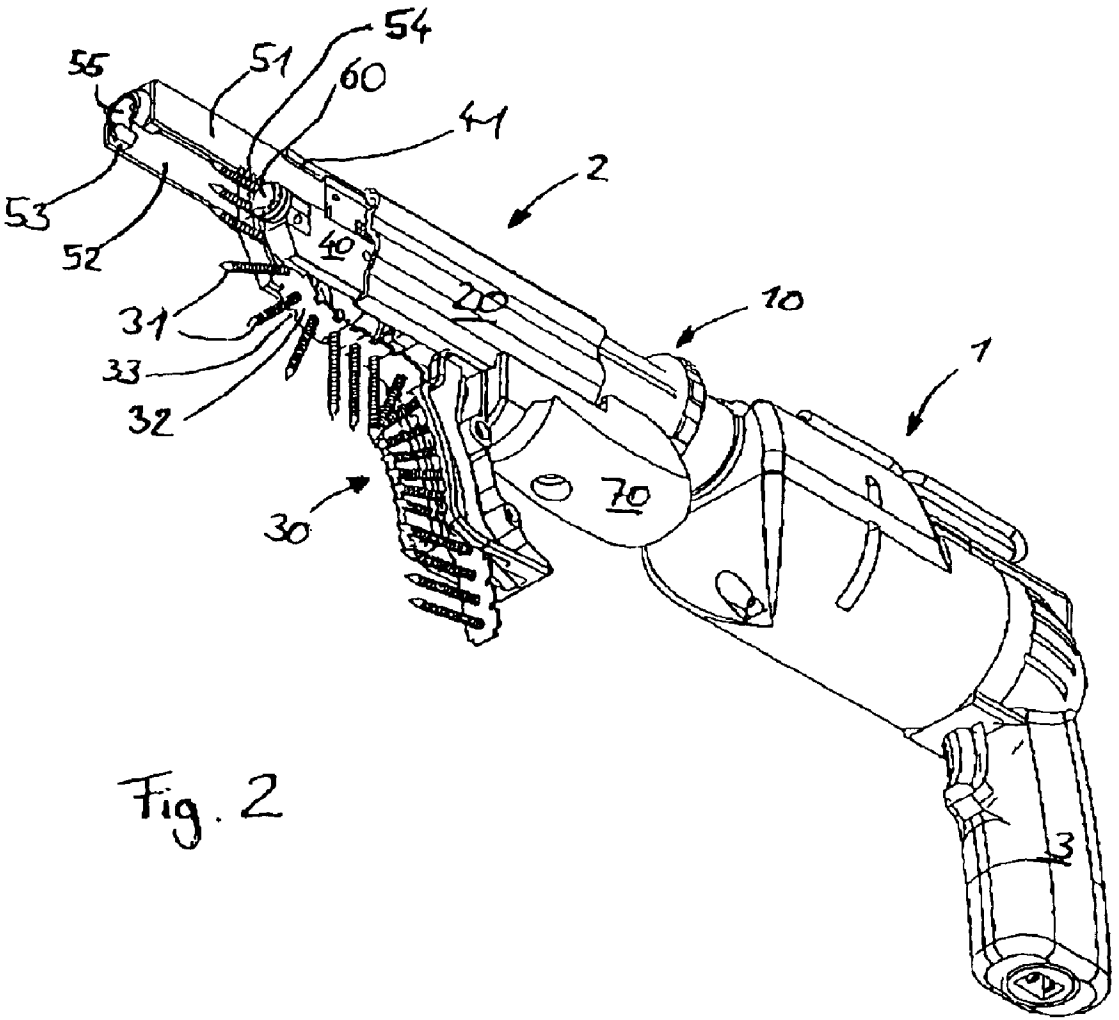
Figure 3:
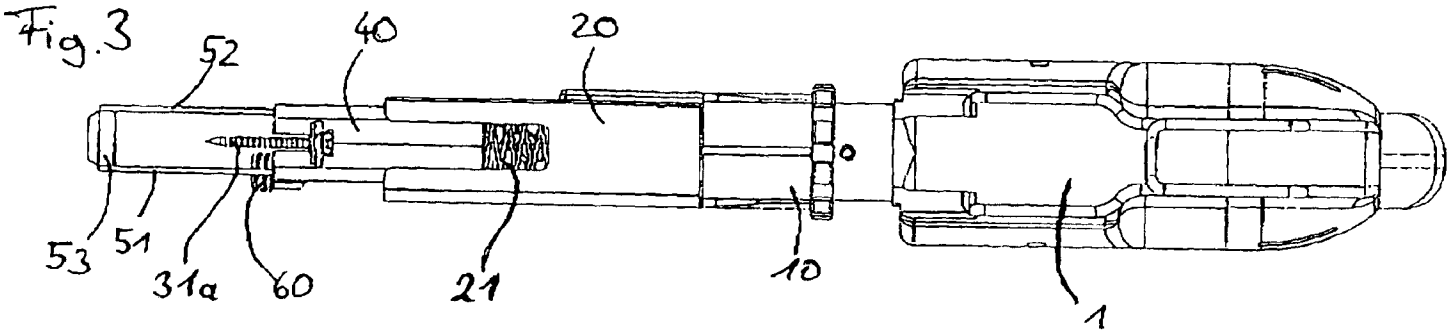
Figure 4:
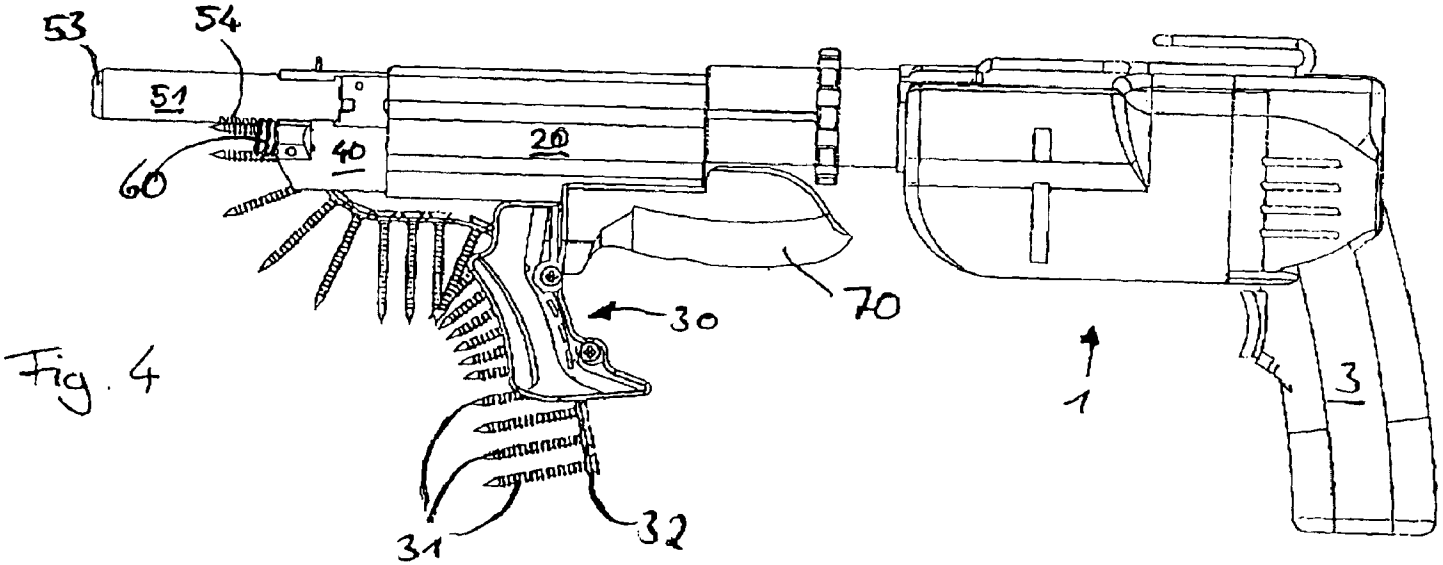
Figure 6:
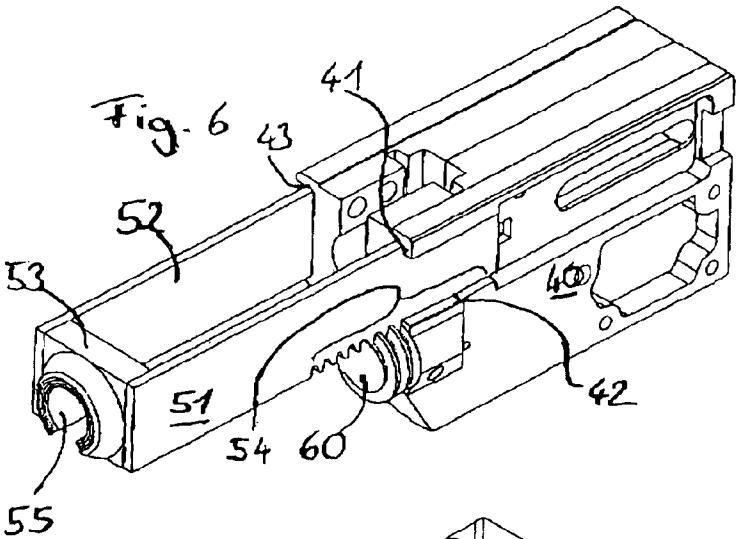
Figure 7:
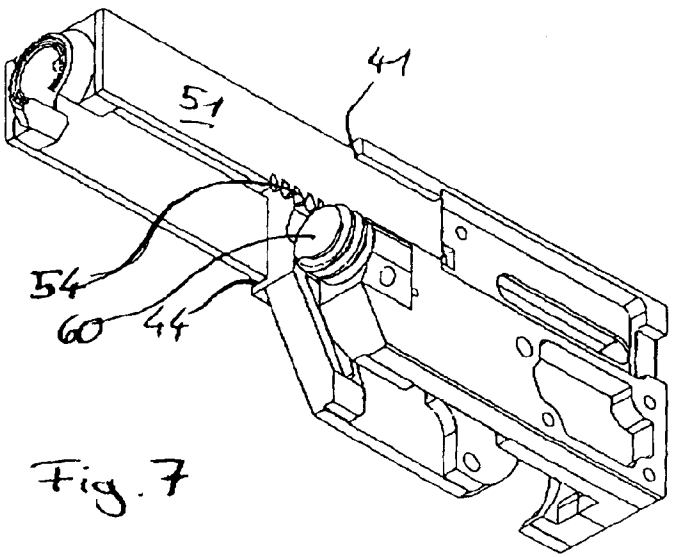
Figure 5:
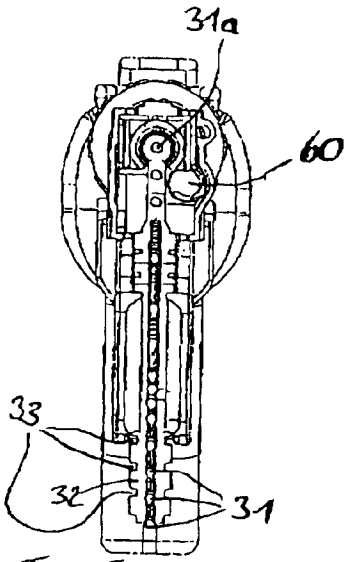
Figure 10:
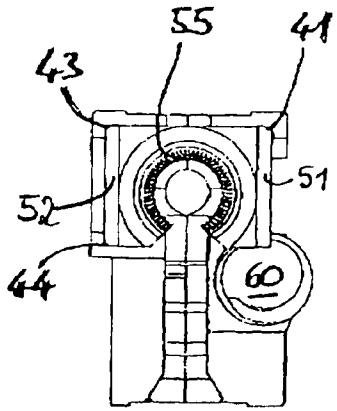
Figure 8:
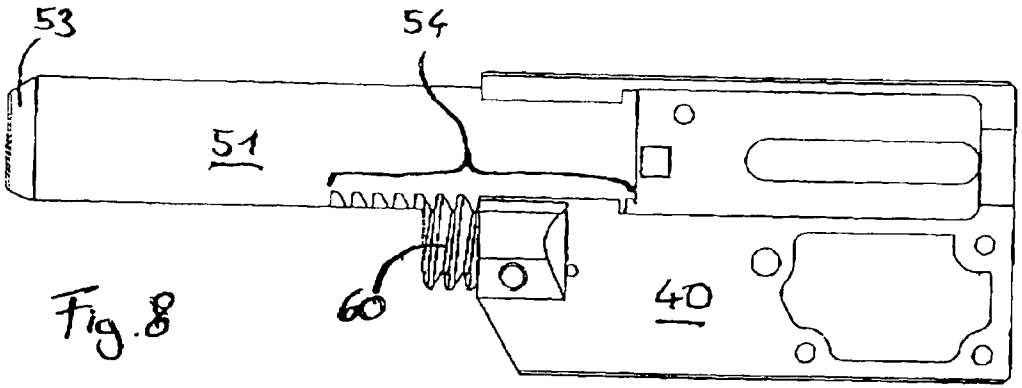
Figure 9:
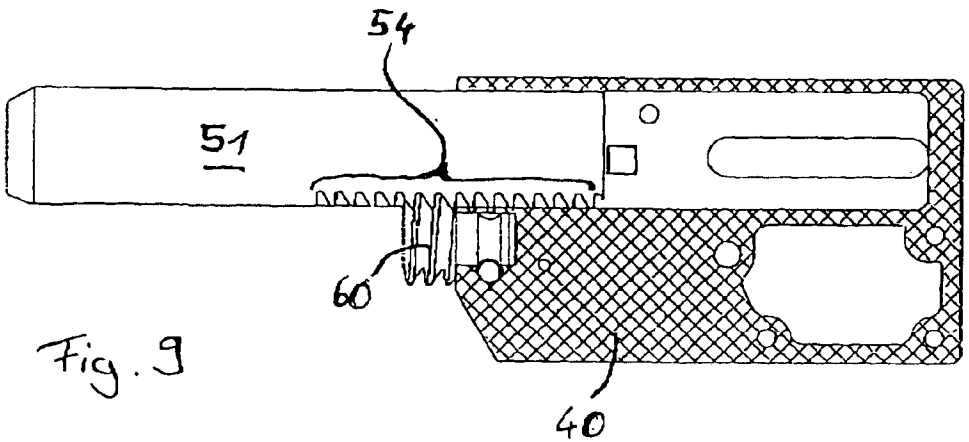
Figure 11:
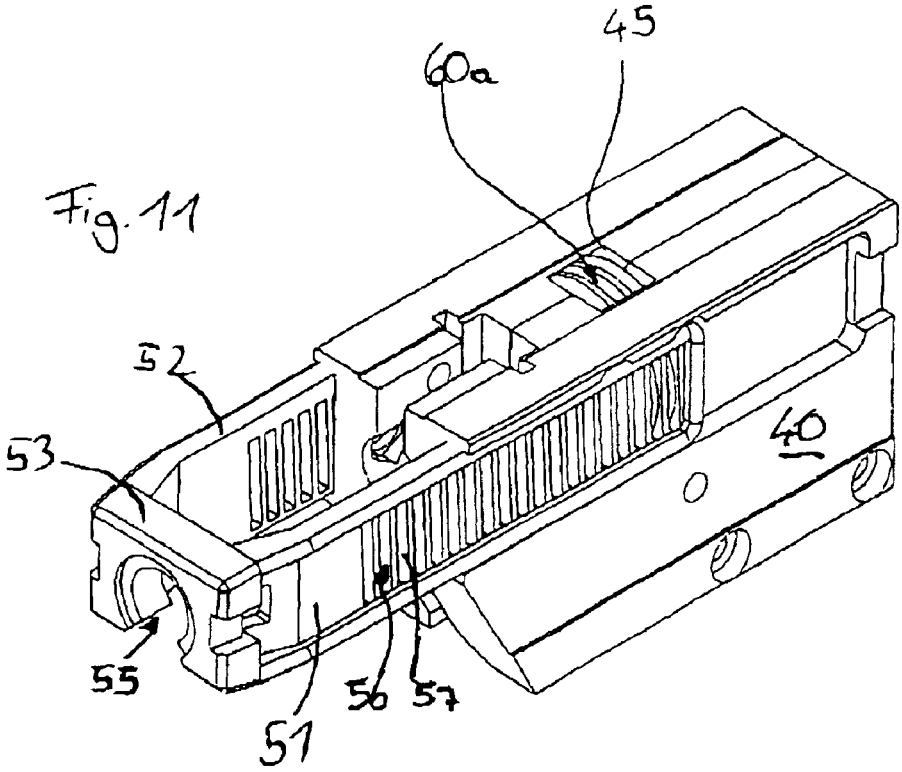
Figure 12:
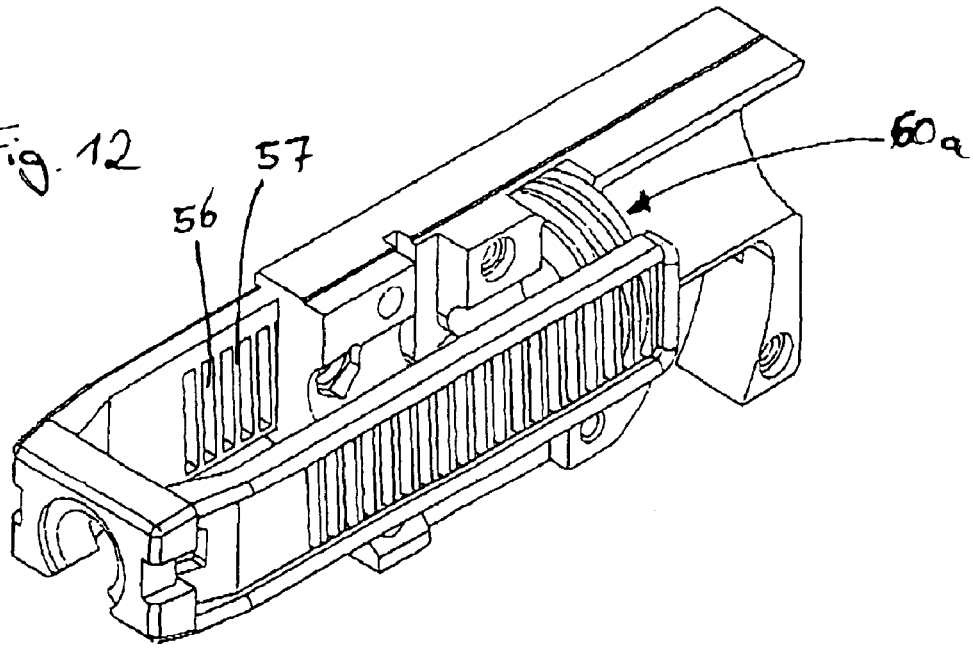
Figure 13:
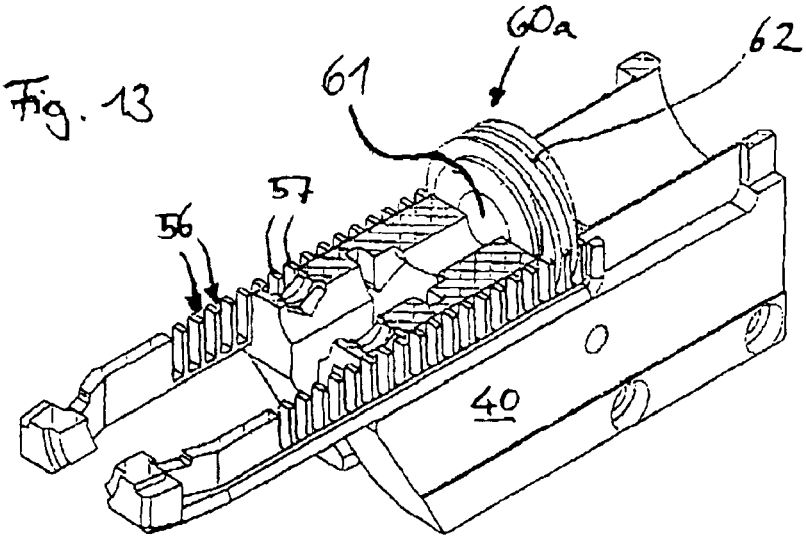
Figure 14:
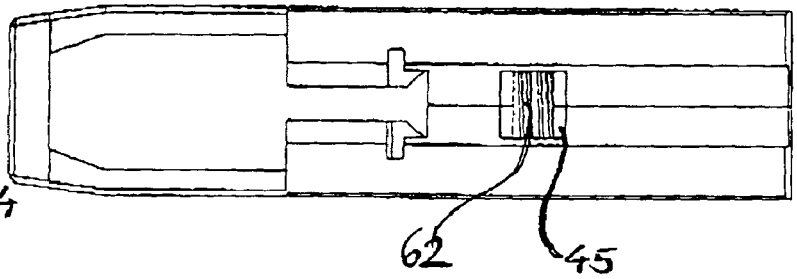
Figure 15:
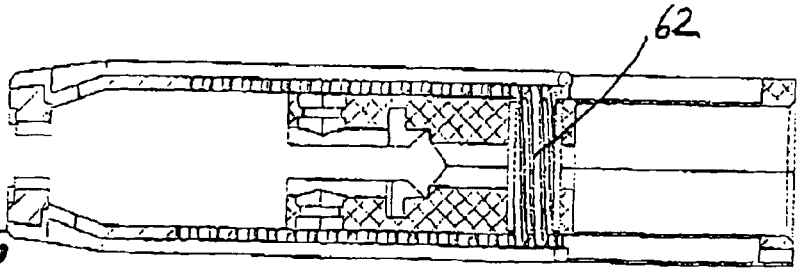
Figure 16:
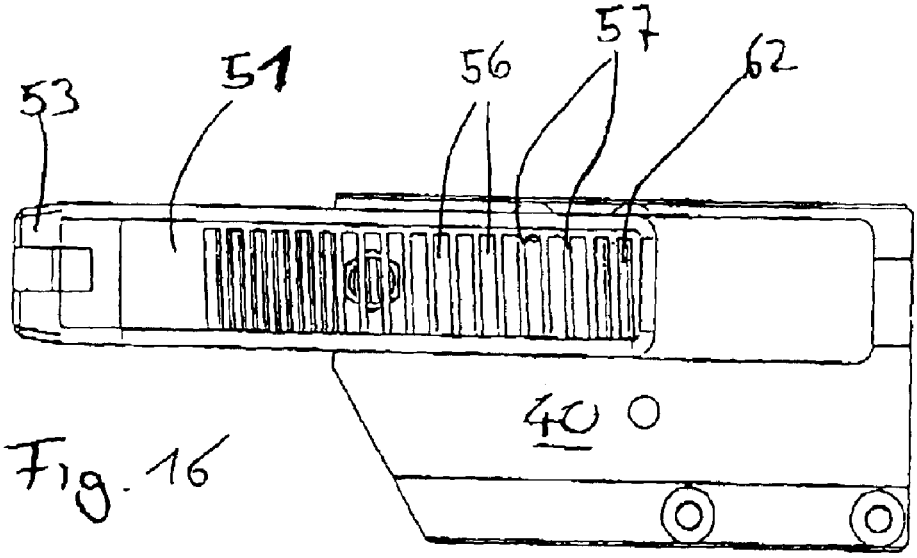
Figure 17:
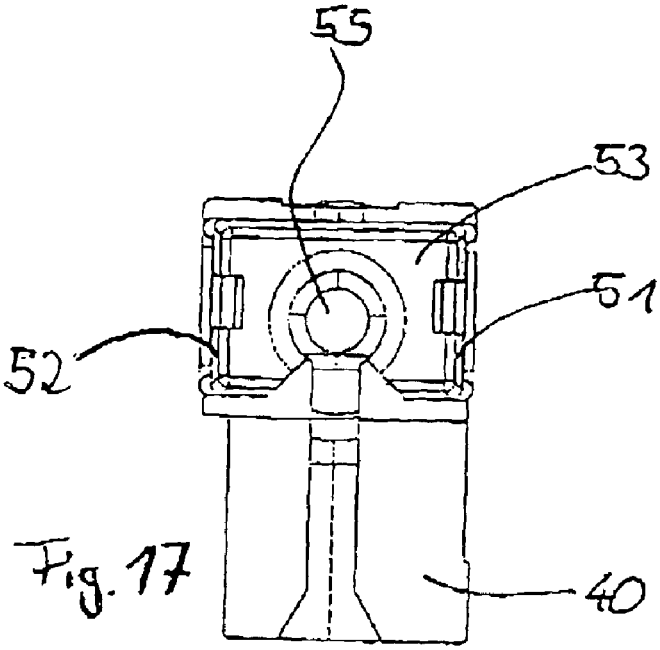

As can well be seen in FIGS. 2 and 4, in particular, there is disposed at the feeder device a first grip portion 70 that, in conjunction with the grip portion 3 on drive motor 1, enables good handling of the equipment.

The longitudinal axes of the screws 31 held in magazine belt 32 run in a plane that extends in the direction of the longitudinal axis from the back to the front and of the normal axis from the top to the bottom of the feeder device. The rotational axis of threaded worm 60 runs parallel to the plane in which screws 31 are guided and is laterally spaced apart from said plane to such a measure that screws 31 may be conveyed past threaded worm 60 into a driving position 31*a*. When a screw is located in driving position 31*a*, the screwdriver bit is able to engage with the head of the screw located in said position when housing portion 20 is moved a little relative to housing portion 40 so that said screw can be driven into a workpiece when the screwdriver bit is made to rotate by the drive of the drive motor.

When the screw is being driven, the tip of the screw is made to advance forwards out of the space between the stop member shanks 51, 52 through a recess 55 in the stop base 53, in order to be screwed into the workpiece situated at the outer side of the stop base 53. As a result of the screwing movement, a relative movement between the first housing portion 20 and the second housing portion 40 is caused by a force operating against pressure springs 21, said force being introduced into the equipment by the operator using grip portions 70, 3 and directed against a contact force applied by the workpiece against the stop base 53. Due to this relative movement, the screwdriver bit rotatably attached in a stationary position inside the first housing portion 20 is advanced forward with the screw as it penetrates the workpiece, thus ensuring secure transmission of torque from the drive of drive motor 1 through the screwdriver bit into the screw.

Driving screw 31 causes it to be detached from magazine belt 32. Due to the relative movement of housing portions 20, 40 towards each other, a feeder mechanism is triggered which, by means of grip elements (not shown) that engage the grooves 33 located in the magazine belt 32, advances the magazine belt by the distance between two adjacent screws held therein when housing portions 20, 40 are moved back to their starting positions by pressure spring 21 after the screwdriving procedure has been completed. Following this step, the next screw thus conveyed into the driving position can be driven immediately.

As previously described and as can be seen from FIGS. 6–10, the stop member 50 is displacably guided on the second housing portion 40 by means of guides 41–44 defined on housing portion 40. A gear rack portion 54 is defined on the lower edge of the left-hand stop member shank 51 and extends as far as the rear end of stop member shank 51 opposite the stop base 53. By turning the threaded worm 60 that is rotatably mounted in a stationary position on the second housing portion 40, the stop member 50 is moved in the direction that screws 31 are being driven and, when it is moved to its maximum extension, can be removed in a forward direction from guides 41–44. Moving stop member 50 by means of threaded worm 60 serves to adapt feeder device 2 to different lengths of screw. In order to ensure that work can proceed quickly and safely, the distance that the stop base 53 is spaced away from the screwdriver bit or the guides of the magazine belt 32 in the area of the screwdriving axis is selected such that the tip of the screw to be driven is slightly distanced from recess 55. When recess 55 is open at the bottom, as in the embodiment, the tip of the screw can also project slightly into recess 55 in stop base 53 when the screw is in the starting position.

In a second embodiment of the equipment according to the invention as shown in FIGS. 11–17, a threaded worm 60*a* is rotatably mounted in a stationary position inside the second housing portion 40 in such a way that its rotational axis is concentric with the rotational axis of the screwdriver bit. As can be seen from FIG. 13 in particular, threaded worm 60*a* has a central bore 61 through which the screwdriver bit or a coupling device receiving the screwdriver bit is able to extend in order to transmit torque from drive motor 1 into screws 31. At the outer encasing surface of threaded worm 60*a*, and in the same manner as in threaded worm 60, a trapezoidal thread 62 is defined that engages with a plurality of parallel ridges in stop member shanks 51, 52. Ridges 57 and slots 56 between ridges 57 extend perpendicular to the rotational axis of threaded worm 60*a*. When threaded worm 60*a* is turned, a force is transferred via ridges 57 from threaded worm 60*a* to the stop member 50, causing a displacement of the stop member 50 relative to threaded worm 60*a* and the second housing portion 40. Slots 56 and ridges 57 are defined on the two stop member shanks 51, 52, and threaded worm 60*a* engages with slots 56 at two approximately opposite points.

Through a window 45 in the second housing portion 40, threaded worm 60*a* can be operated manually to make threaded worm 60*a* turn.

What is claimed:

1. Apparatus for driving fasteners with a motor-drivable feeder that moves the fasteners sequentially from a feed position into a driving position, and with an adjustment means comprised of a stop member that is movable in the screwdriving direction relative to the feeder and has a stop face extending substantially perpendicular to the screwdriving direction, wherein the adjustment means comprises a manually rotatable thread member mounted stationary in or on the feeder the thread of said thread member engaging interlockingly with the stop member and moving the stop member continuously relative to the feeder on being so turned.

2. Apparatus according to claim 1, wherein the thread of the thread member is an external thread with its axis running parallel or perpendicular to the screwdriving direction.

3. Apparatus according to claim 1, wherein the thread member comprises a manually operable portion.

4. Apparatus according to claim 2, wherein the external thread of the thread member passes through the stop member in a radial direction.

5. Apparatus according to claim 4, wherein the stop member has at least one slot disposed perpendicular to the screwdriving direction for establishing positive engagement with the thread of the thread member, said slot(s) having a width that limits the axial path of the thread on both sides.

6. Apparatus according to claim 5, wherein the thread member is a rotationally symmetric member with a central bore through which a force transmission member of the motor drive can pass during the screwdriving process.

7. Apparatus according to claim 5 wherein the stop member is configured to have a U-shape and has slots on its two shanks, which extend parallel to the screwdriving direction and are guided on two opposite sides of the feeder, and the stop face is located on the side of the stop member facing away from the feeder and has a hole through which the fasteners can pass.

8. Apparatus according to claim 1, wherein the thread member has an internal thread and the stop member has an external thread or portions of an external thread.

9. Apparatus according claim 1, wherein the stop member has at least one protrusion that engages at least with the thread of the thread member so that force can be transmitted interlockingly between the thread flanks and at least one surface of the protrusion.

10. Apparatus according to claim 9, wherein the thread member is a rotationally symmetric member with its axis of rotation lying parallel to the screwdriving direction and spaced apart from the screwdriving axis.

11. Apparatus according to claim 9, wherein the stop member is U- or L-shaped and is guided along the feeder with at least one side shank extending parallel to the screwdriving direction, and that a protrusion is formed on an edge of at least one side of the stop member extending parallel to the screwdriving direction.

12. Apparatus according to claim 11, wherein said equipment is coupled with a mains- or battery-powered motor for driving the feeder.

13. Apparatus according to claim 12, wherein the mains- or battery-powered motor has a cylindrical mounting surface and the equipment is force-locked onto said surface.

* * * * *

UNITED STATES PATENT AND TRADEMARK OFFICE

CERTIFICATE OF CORRECTION

PATENT NO. : 6,915,724 B2
DATED : August 12, 2005
INVENTOR(S) : Kigel et al.

It is certified that error appears in the above-identified patent and that said Letters Patent is hereby corrected as shown below:

Title page,
Item [30], Foreign Application Priority Data, after "202 14 489", delete "U" and add -- .5 --.

Column 2,
Line 42, after "handwheel" add -- or a similar tool --.

Column 3,
Lines 42-51, should read as one continuous paragraph.

Signed and Sealed this

Twenty-first Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,915,724 B2
DATED : July 12, 2005
INVENTOR(S) : Kigel et al.

It is certified that error appears in the above-identified patent and that said Letters Patent is hereby corrected as shown below:

Title page,
Item [30], Foreign Application Priority Data, after "202 14 489", delete "U" and add -- .5 --.

Column 2,
Line 42, after "handwheel" add -- or a similar tool --.

Column 3,
Lines 42-51, should read as one continuous paragraph.

This certificate supersedes Certificate of Correction issued March 21, 2006.

Signed and Sealed this

Second Day of May, 2006

JON W. DUDAS
*Director of the United States Patent and Trademark Office*